US006747574B2

(12) United States Patent
Butzer et al.

(10) Patent No.: US 6,747,574 B2
(45) Date of Patent: Jun. 8, 2004

(54) TRAFFIC CONTROL DEVICE TRANSMITTER, RECEIVER, RELAY AND DISPLAY SYSTEM

(76) Inventors: George L. Butzer, 1380 Harrison Pond Dr., New Albany, OH (US) 43054; Dane C. Butzer, 681 Woodduck Ct., Columbus, OH (US) 43215

( * ) Notice: Subject to any disclaimer, the term of this patent is extended or adjusted under 35 U.S.C. 154(b) by 70 days.

(21) Appl. No.: 10/028,965

(22) Filed: Dec. 21, 2001

(65) Prior Publication Data

US 2003/0095043 A1 May 22, 2003

Related U.S. Application Data

(60) Provisional application No. 60/333,308, filed on Nov. 16, 2001.

(51) Int. Cl.[7] ..... G08G 1/095

(52) U.S. Cl. ..... 340/907; 340/905; 340/539.13; 340/5.8

(58) Field of Search ..... 340/907, 908, 340/905, 539.13, 5.8; 701/117, 211

(56) References Cited

U.S. PATENT DOCUMENTS 5,712,632 A * 1/1998 Nishimura ..... 340/905
5,973,616 A * 10/1999 Grebe ..... 340/825.69
6,008,741 A * 12/1999 Shinagawa ..... 340/907
6,055,478 A * 4/2000 Heron ..... 340/990
6,243,644 B1 * 6/2001 Dengler ..... 340/933
6,442,473 B1 * 8/2002 Berstis ..... 340/907

* cited by examiner

*Primary Examiner*—Anh V. La

(57) ABSTRACT

A traffic control device information display system. This system includes a receiver that receives information from a traffic control device transmitter for a traffic control device, a processor that processes the information to determine identification information and location information for the traffic control device, and a display that displays the identification information and the location information to an operator. The display highlights traffic control devices for which an error is detected in the location information. This error could be, for example, a reported location that does not match a proper location or a missing reported location, thereby indicating that the traffic control device may have been improperly moved or knocked down. The system can be provided in a vehicle or in a central office.

24 Claims, 5 Drawing Sheets

TRAFFIC CONTROL DEVICE TRANSMITTER, RECEIVER, RELAY AND DISPLAY SYSTEM

CROSS REFERENCE TO PROVISIONAL APPLICATION

This application claims priority from U.S. Provisional Application No. 60/333,308 filed Nov. 16, 2001.

BACKGROUND OF THE INVENTION

1. Field of the Invention

This invention relates to the filed of traffic control devices such as signals and signs. In particular, the invention relates to a transmitter for such devices that can transmit identification and location information and possible state and/or status information for the device. The invention also relates to receiver, relay and display systems for the information.

2. Description of the Related Art

As populations become more urbanized, the number and types of traffic control devices such as signals and signs increases. In more rural areas, the traffic control devices can be spread over a wide area. In both cases, significant effort is often required simply to survey the traffic control devices to make sure that they have not been knocked down, blown over, improperly relocated or moved, or the like.

In addition, conventional traffic control devices rely completely on visual recognition by a driver. Sometimes, the devices can be obscured, for example by trees or fog. Other times, the number of devices can be confusing, especially to inexperienced drivers.

Knocked down, blown over, improperly relocated or moved, and obscured traffic control devices are ineffective. These circumstances can lead to accidents, possibly resulting in severe injury and even death. Accordingly, a solution to these problems is needed.

SUMMARY OF THE INVENTION

The invention includes a traffic control device transmitter. The transmitter includes amount that attaches the transmitter to a traffic control device and a transmission element that transmits identification information and location information corresponding to the traffic control device. In one embodiment, the mount is a mounting bracket. Preferably, the traffic control device transmitter also includes storage for storing the identification information and the location information.

Examples of the identification information include but are not limited to the following: a device number for the traffic control device as designated in the National Manual on Uniform Traffic Control Devices; a sign legend for the traffic control device; and a numeric code corresponding to the type of the traffic control device.

The location information can be pre-stored location information. Alternatively, the transmitter according to the invention can also include a location detection element that determines the location information. One example of such an element is a Global Positioning System.

The storage and the transmission element of the transmitter can receive power from the traffic control device or from some other power source such as a photovoltaic solar cell or a battery.

The transmitter according to the invention can also include a monitoring element that monitors a state and/or status of the traffic control device. In this embodiment, the transmission element also transmits the state and/or status of the traffic control device.

The foregoing aspect of the invention transmits identification, location, and possibly state and/or status information. The invention also includes a traffic control device information display system that uses the transmitted information.

The traffic control device information display system according to the invention includes a receiver that receives information from a traffic control device transmitter for a traffic control device, a processor that processes the information to determine identification information and location information for the traffic control device, and a display that displays the identification information and the location information to an operator.

In one embodiment, the processor also determines state and/or status information for the traffic control device from the received information. Then, the state and/or status information can also be displayed to the operator.

The traffic control device information display system can be mounted inside a vehicle, for example. In that case, the display can be a heads-up display that projects the identification information and the location information onto the vehicle's windshield. Alternatively, the display can be a CRT or an LCD display.

By virtue of the foregoing arrangements, vehicle operators can be informed of the identity and location of upcoming traffic control devices. Thus, even if these devices are obscured, the operator will be aware of them. Furthermore, the operator can even be informed of the state and/or status (e.g., red light or green light) of the traffic control devices, even if they are completely obscured.

The display system also can be located in a central office to allow for centralized monitoring of traffic control device identity, location, and possibly state and/or status. This arrangement allows for centralized monitoring of the location of traffic control devices, allowing rapid identification and correction of problems such as knocked-down devices and improperly moved or removed devices. Furthermore, centralized monitoring of an entire traffic control system is facilitated.

One problem with the central office arrangement described above is that small traffic control device transmitters may not have the range to reach to a central office. Thus, the invention also includes a relay and display system for the transmitted information.

The traffic control device information relay and display system according to the invention includes a first receiver that receives information from a transmitter for a traffic control device, a retransmitter that retransmits the information received by the first receiver, and a second receiver the receives the retransmitted information. The relay and display system also includes a processor that processes the retransmitted information to determine identification information and location information for the traffic control device, and a display that displays the identification information and the location information to an operator.

The retransmitter can retransmit the information in a different format than the information was received by the first receiver. Alternatively, the same format can be utilized.

In one embodiment of the invention, the first receiver and retransmitter are located in a vehicle. For example, a specialized roaming vehicle can be utilized. Alternatively, every vehicle with a traffic control device information display system according to the invention can be configure to also be a relay (i.e., with a retransmitter), thereby providing for automatic and extensive coverage of a wide area. In another embodiment, the first receiver and retransmitter can be located in a fixed installation, for example a relay station or tower. Plural such stations or towers can be used to cover an entire area.

In the traffic control device information relay and display system, the processor and the display can be located in a central office so as to allow for centralized monitoring. In this case, the invention can also utilize wireless remote control devices for wireless remote control of traffic control devices from the central office.

This brief summary has been provided so that the nature of the invention may be understood quickly. A more complete understanding of the invention may be obtained by reference to the following description of the preferred embodiments thereof in connection with the attached drawings.

DESCRIPTION OF THE PREFERRED EMBODIMENTS

Overview

Figure 1:
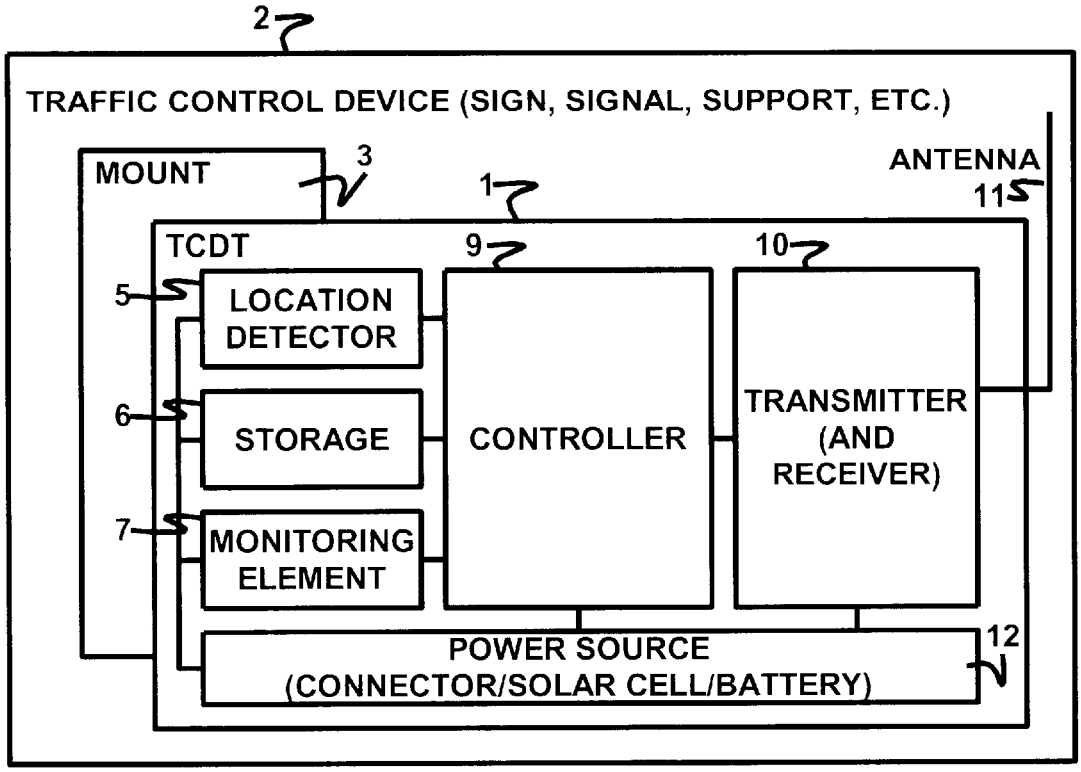
FIG. 1 shows a block diagram of a traffic control device transmitter according to the invention.

The traffic control device transmitter (TCDT) is a transmitter attached to a traffic control device that transmits information regarding the type of traffic control device and its location to a receiver at either a fixed or mobile location. The device alternatively can also monitor and/or report on the operational status of any traffic control device, although the invention includes devices that do not monitor and/or report on the operational status of traffic control devices.

Traffic control devices include but are not limited to a traffic signal, traffic sign and/or the support to which the traffic control device is attached. Traffic signals include but are not limited to vehicular traffic signals and/or pedestrian signals installed at intersections and/or mid block locations to control traffic; vehicular traffic signals installed on ramps to control traffic entering freeways and/or expressways; overhead lane control signals; flashing beacons; and, any other traffic signal recognized and described in the National Manual on Uniform Traffic Control Devices (NMUTCD) and various state Manuals on Uniform Traffic Control Devices (MUTCDs). Traffic signs include but are not limited to regulatory, warning, motorist information, guide and any other sign recognized and described in the NMUTCD or state MUTCDs. Supports include but are not limited to any device used to support the traffic signal and/or sign. Traffic includes but is not limited to motorized vehicles, non-motorized vehicles and pedestrians.

The Traffic Control Device Transmitter (TCDT) is a device attached to the traffic control device or traffic control device support. The TCDT transmits information that identifies the type of traffic control device and its location. The device may use programmed information regarding the traffic control device location or it may use Global Positioning System receivers to obtain this information. The TCDT may be powered by AC or DC power, battery power and/or solar power. In one variation of the device, a Global Positioning System is incorporated into the TCDT.

Typical applications for the TCDT include but are not limited to the following. The applications can apply to any and all traffic control devices and their supports.

Mobile or Portable Application

The device is used to transmit information on the traffic control device to a receiver mounted in or on a motorized or non-motorized vehicle or to a device carried by a pedestrian. In the vehicle application, the information is received by the vehicle's receiver, and the information is displayed on an in-vehicle device. The in-vehicle device display may be visual, verbal or both. The visual display may be a "heads up" display overlaid on the vehicle windshield or a separate display such as a liquid crystal or CRT display. The in-vehicle display may show the traffic control device number designation per the NMUTCD, a graphic of the traffic control device or a word message describing the device or a combination of the above.

As an example: A STOP sign TCDT may transmit the device number shown in the NMUTCD (R1-1) or a state MUTCD, the sign legend (STOP), a word description (Stop Sign) and the location of the sign or a combination or variation of the above. Similarly, the information may be transmitted to a hand held receiver and displayed by the hand held device as described above. The information displayed may be any one or a combination of the items sent by the TCDT. The TCDT may be used in a similar manner on other traffic control devices.

Fixed Location Receiver Application

The device is used to transmit information on the traffic control device to a receiver at a fixed location such as, but not limited to, a traffic signal control cabinet, a ramp meter control cabinet or a traffic monitoring cabinet. The information may include but not be limited to data regarding the type of traffic control device and its location. This receiver may be used by the agency responsible for the installation, maintenance, repair and/or replacement of the traffic control device (the agency) to monitor the traffic control device's location. The built-in Global Positioning System will sense any movement in the traffic control device and transmit this information so that the agency can monitor knock downs, repositioning or removal of the traffic control device. The TCDT can also monitor and/or report on the operational status of any traffic control device, although the invention includes devices that do not monitor and/or report on the operational status of traffic control devices.

Mobile Receiver Relay Application

The device is used to transmit information on the traffic control device to a receiver in a vehicle which in turn transmits the information to a fixed location. The information may include but not be limited to information regarding the type of traffic control device and its location. This receiver may be used by the agency to monitor the traffic control device's location. The built-in Global Positioning System will sense any movement in the traffic control device and transmit this information so that the agency can monitor knock downs, repositioning or removal of the traffic control device. The TCDT can also monitor and/or report on the operational status of any traffic control device, although the invention includes devices that do not monitor and/or report on the operational status of traffic control devices.

DETAILED DESCRIPTION

FIG. 1 shows a block diagram of a traffic control device transmitter according to the invention.

Briefly, the traffic control device transmitter includes a mount that attaches the transmitter to a traffic control device and a transmission element that transmits identification information and location information corresponding to the traffic control device. Preferably, the traffic control device transmitter also includes storage for the identification and location information.

In FIG. 1, traffic control device transmitter (TCDT) 1 is attached to traffic control device 2 via mount 3. TCDT 1 includes location detector 5, storage 6, monitoring element 7, controller 9, transmitter 10, antenna 11, and power 12.

Location detector 5 preferably is a device or mechanism that determines the present location of TCDT 1. In the preferred embodiment, location detector 5 is a Global Positioning System (GPS), preferably a "GPS on a chip." TCDTs that include a GPS are referred to as "GPS-enabled" herein. Alternatively, location detector 5 can be any other type of location detection device, for example an inertia-based system or the like. In another embodiment of the invention, location detector 5 is omitted.

Storage 6 can be embodied as any type memory (e.g., RAM, ROM, EPROM, EEPROM, etc.). Storage 6 preferably stores location information provided by location detector 5, in which case storage 6 should be writeable. If location detector 5 is omitted, storage 6 can simply hold pre-stored location information, in which case storage 6 can be read-only.

Storage 6 also preferably stores identification information about the type of traffic control device 2. The identification information can also include a unique identifier for the particular traffic control device or TCDT, for example a serial number or device number.

The identification information can be set when TCDT 1 is attached to a traffic control device, for example through programming, through an I/O device such as a keypad, or through setting one or more DIP switches. Alternatively, the identification information can be preset, in which case the TCDT should only be mounted to the type of traffic control device corresponding to the preset identification information.

Storage 6 also can store other information such as state and/or status information for traffic control device 2 and/or TCDT 1.

In an alternative embodiment of the invention, storage 6 is omitted. In this embodiment, location detector 5 can directly provide location information to transmitter 10 without the information being stored. Likewise, some other technique can be used to provide the location and identification information. For example, the settings of DIP switches can "store" the information, or variable or fixed resistors, capacitors or inductors can be set to provide the information. Also, the identification and location information can be provided by traffic control device 2 itself. In this case, both location detector 5 and storage 6 can be (but need not be) omitted from TCDT 1. Other arrangements are possible.

Optional monitoring element 7 monitors a state and/or status of traffic control device 2. Preferably, the state information is particular to the type of traffic control device 2. For example, for a traffic signal, the state information could include the current color of light being displayed (e.g., red, yellow or green), the type of light (e.g., left turn), and possibly how long the signal has left in its current state. For a speed limit sign, the state information could be static speed limit information (e.g., 65 mph).

The status information preferably includes whether or not traffic control device 2 is operating properly. Any other type of state and/or status information for traffic control device 2 can be monitored and is within the scope of the invention.

The state and/or status information also can relate to the state and/or status of TCDT 1, for example to indicate a low battery or other operational problem.

If traffic control device 2 is an "active" device (e.g., a traffic signal), monitoring element 7 can be a simple connection to state and/or status information generated by the traffic control device itself. Alternatively, actual monitoring circuits can be utilized.

As mentioned above, storage 6 can store the state and/or status information provided by monitoring element 7. If monitoring element 7 is omitted, storage 6 can simply hold static state and/or status information (e.g., a speed limit value).

Controller 9 is provided for controlling more complex implementations of the invention. Controller 9 preferably is a central processor configured and programmed to control TCDT 1. Simpler implementations of TCDT 1 may not need a controller, in which case controller 9 also can be omitted from the TCDT.

Transmitter 10 transmits the identification information and location information corresponding to traffic control device 2, preferably through antenna 11. Transmitter 10 also can transmit state and/or status information for traffic control device 2 and/or TCDT 1, if available. In the preferred embodiment of the invention, wireless transmission is used.

In the embodiment of the invention shown in FIG. 1, the information to be transmitted is stored in storage 6, and transmission of the information is controlled by controller 9. Transmitter 10 is essential to the invention.

Sometimes, many TCDTs might be located in close proximity to one another. Accordingly, the TCDTs preferably utilize some form of frequency or spectrum sharing. Techniques for such sharing are well known in the art of cellular and PCS phone technology. Examples of such techniques include spectrum division, time division multiplexing, and the like. These techniques are applicable to the invention. Some of these techniques require hand shaking and negotiation between devices. To this end, transmitter 10 can also incorporate a receiver, or a separate receiver (not shown) can be provided. This receiver allows controller 9 to carry out any necessary hand shaking and negotiations.

Power source 12 provides power to the elements of TCDT 1. Examples of power source 12 include a connector to power provided by traffic control device 2, photovoltaic solar cell(s), and one or more batteries. Combinations of these power source can be utilized. A preferred embodiment uses one or more solar cells during the day and rechargeable batteries during the night. In this configuration, the batteries can be recharged by the solar cells during the day.

While the elements of TCDT 1 are shown separately in FIG. 1, they can be combined in actual implementation of the invention. For example, storage 6, controller 9, transmitter 10, and antenna 11 could all be combined into a single circuit or chip.

As mentioned above, TCDT 1 includes mount 3 for attachment to traffic control device 2. In a preferred embodiment, the mount is a mounting bracket. Alternatively, the mount can be an extrusion or other molding integrated in the traffic control device, or even something as simple as a bolt hole for attachment of TCDT 1 to traffic control device 2.

Figure 2:
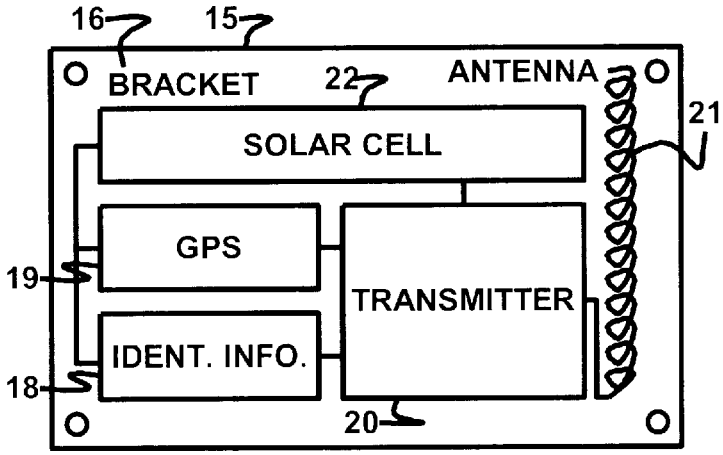
FIG. 2 shows one possible embodiment of a traffic control device transmitter according to the invention.

FIG. 2 shows one possible embodiment of a traffic control device transmitter according to the invention. This embodiment is a simpler implementation than that shown in FIG. 1.

In FIG. 2, TCDT 15 includes bracket 16 with bolt or screw holes for attachment 22 to a traffic control device (not shown). TCDT 15 also includes identification information element 18. Examples of identification information element 18 include, but are not limited to, a memory, resistors, capacitors or inductors programmed or set to correspond to an identification value for a traffic control device. In addition, TCDT 15 includes GPS chip 19 for providing location information.

Transmitter 20 transmits the identification information from identification information element 18 and the location information from GPS chip 19 using antenna 21. Solar cell 22 provides power for the elements of TCDT 15.

Figure 3:
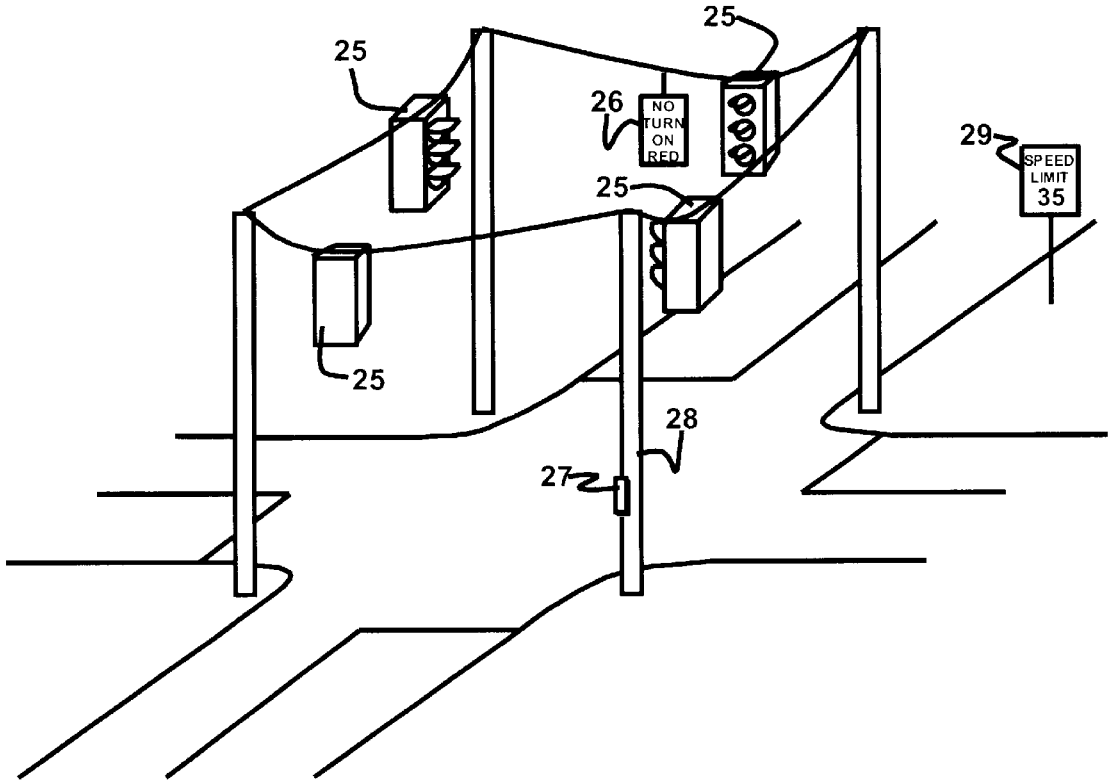
FIG. 3 shows examples of traffic control devices with which the invention can be used.

FIG. 3 shows examples of traffic control devices with which the invention can be used. A TCDT according to the invention can be used with traffic signals 25, hanging signs 26, control boxes 27, light and/or utility poles 28, and street signs 29. The TCDT also can be used with any other types of traffic control devices and their supports (i.e., poles or other support structures).

Figure 4:
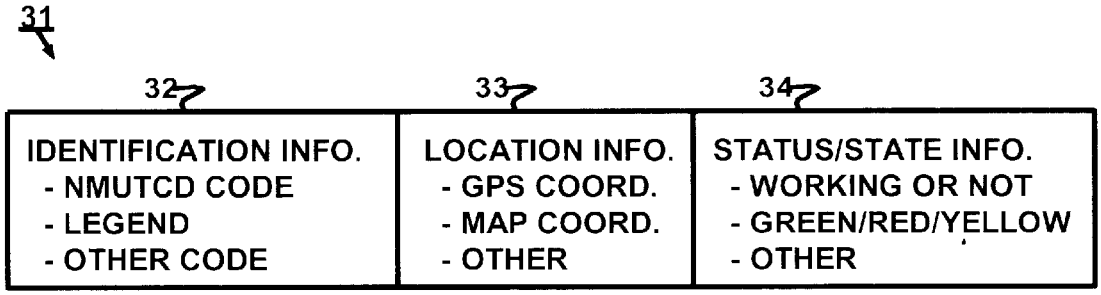
FIG. 4 shows a possible format for transmitting identification, location, status and/or state information for a traffic control device according to the invention.

FIG. 4 shows a possible format for transmitting identification, location, status and/or state information for a traffic control device according to the invention. The format shown in FIG. 4 represents one frame that preferably is repeated.

Frame 31 includes identification information 32, location information 33, and status/state information 34. Examples of the identification information include but are not limited to the following: a device number for the traffic control device as designated in the National Manual on Uniform Traffic Control Devices (i.e., a NMUTCD code) or in a state Manual; a sign legend for the traffic control device; and a numeric or other code corresponding to the type of the traffic control device. The identification information can also include a unique identifier for the particular traffic control device or TCDT, for example a serial number or device number.

Examples of location information 33 include GPS coordinates, map coordinates, or any other type of location information.

Examples of status/state information 34 include information about whether or not the traffic control device is working, a green/red/yellow indicator for a traffic signal, and any other status/state information.

Other formats including non-frame based formats can be used by the invention. In addition, any modulation technique can be used to transmit the information. The invention is equally applicable to these other transmission formats and techniques.

Figure 5:
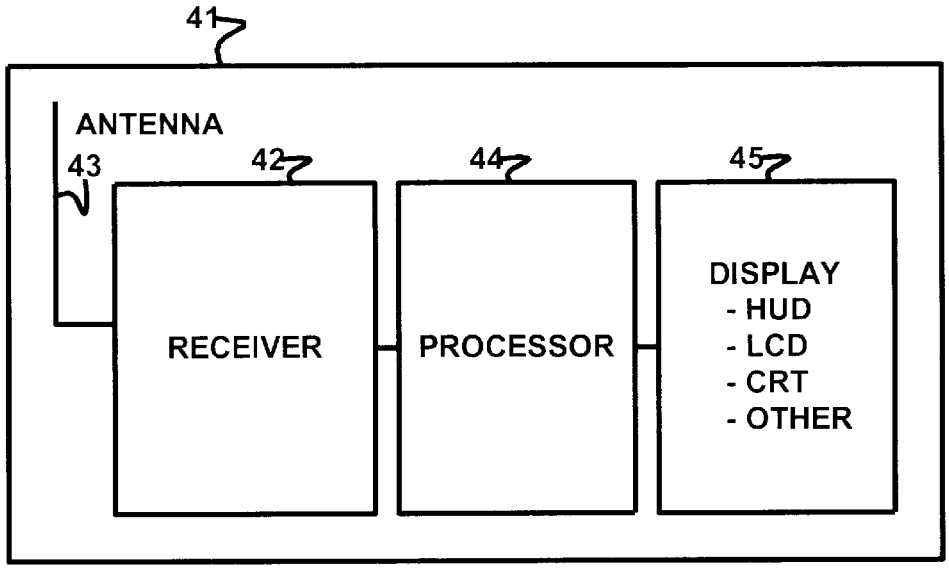
FIG. 5 shows a block diagram of a traffic control device information display system according to the invention.

The TCDT discussed above transmits identification, location, and possibly state and/or status information. The invention also includes a traffic control device information display system that uses the transmitted information. FIG. 5 shows a block diagram of a traffic control device information display system (TCDIDS) according to the invention.

Briefly, the traffic control device information display system according to the invention includes a receiver that receives information from a traffic control device transmitter for a traffic control device, a processor that processes the information to determine identification information and location information for the traffic control device, and a display that displays the identification information and the location information to an operator.

In FIG. 5, TCDIDS 41 includes receiver 42 the receives information from TCDTs, preferably through antenna 43. This information is decoded and processed by processor 44, which preferably is a CPU based processor operating under program control. The decoded and processed information is then displayed on display 45.

The traffic control device information display system can be mounted inside a vehicle. In that case, the display can be a heads-up display (HUD) that projects the identification information and the location information onto the vehicle's windshield. Alternatively, the display can be a CRT, LCD, or other type of display. Furthermore, in this disclosure, the term "display" is broadly defined as encompassing any device or technique for conveying information; "display" is not limited to a visual display. For example, an audible display based on speech generation is also within the scope of the invention. Specific examples of in-vehicle displays are discussed below with reference to FIG. 8.

In addition, the display system can be embodied in a hand-held or other portable or mobile device. For example, the invention can be implemented as an expansion card for a notebook computer, a Palm Pilot or other personal data assistant (PDA), or the like. The invention also can be implemented as a dedicated hand-held or other portable or mobile device. These arrangements allow for great flexibility in monitoring the location, identity, and possibly state and/or status of traffic control devices.

When combined with an audible display, a hand-held or other portable or mobile implementation of the invention would be beneficial to vision-impaired or blind users. For example, such units could assist those users in determining their location, locating pedestrian signal pushbuttons, determining the status of pedestrian or other signals, etc. Possible generated speech for such an audible display could include, for example, "approaching the intersection of Main Street and High Street," "don't walk," "walk", "push button for pedestrian signal 10 feet ahead," "walk signal displayed to cross Main Street," "traffic crossing Main Street has a green light," etc. Of course, many other possibilities exist for generated speech for an audible display for the invention.

The display system can also be located in a central office to allow for centralized monitoring of traffic control devices. This arrangement allows for centralized monitoring of the location of traffic control devices, allowing rapid identification and correction of problems such as knocked-down devices and improperly moved or removed devices. Furthermore, centralized monitoring of state and/or status of the devices is facilitated. Examples of displays in a central office are discussed below with reference to FIG. 9.

One problem with the central office arrangement described above is that small traffic control device transmitters may not have the range to reach to a central office. Thus, the invention also includes a relay and display system for the transmitted information.

The traffic control device information relay and display system according to the invention includes a first receiver that receives information from a transmitter for a traffic control device, a retransmitter that retransmits the information received by the first receiver, and a second receiver the receives the retransmitted information. The relay and display system also includes a processor that processes the retransmitted information to determine identification information and location information for the traffic control device, and a display that displays the identification information and the location information to an operator.

In this system, the second receiver, processor, and display can be arranged substantially as shown in FIG. 5, except that the system might be tuned to a different frequency or process information in a different format. The first receiver and retransmitter that retransmits the information can be embodied in a relay device.

Figure 6:
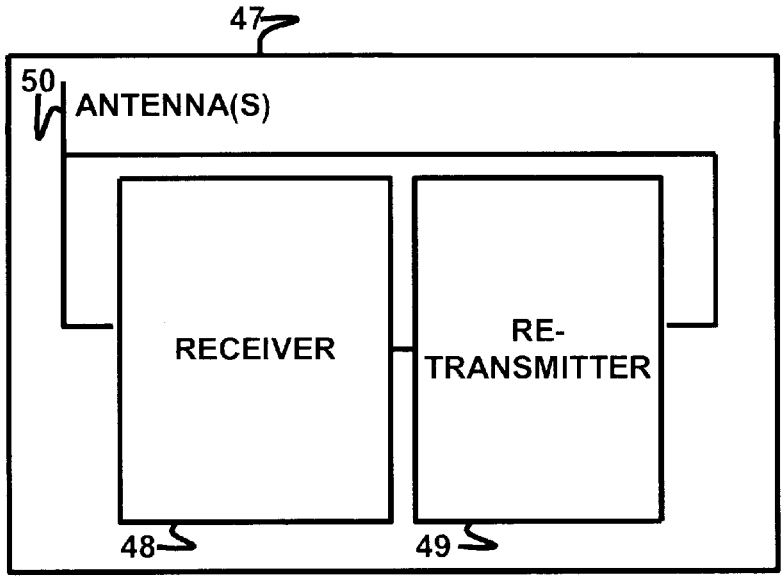
FIG. 6 shows a block diagram of a relay device for use with a traffic control device transmitter and receiver system according to the invention.

FIG. 6 shows a block diagram of a relay device for use with a traffic control device transmitter and receiver system according to the invention. Relay device 47 includes first receiver 48 and retransmitter 49, which both preferably share antenna(s) 50. The retransmitter can retransmit the information on a different frequency and/or in a different format than the information was received by the first receiver. Alternatively, the same format and/or frequency can be utilized.

Other embodiments of a relay device are possible. Generally, any wireless relay device can serve the function of the first receiver and retransmitter in the relay and display system according to the invention.

Figure 7:
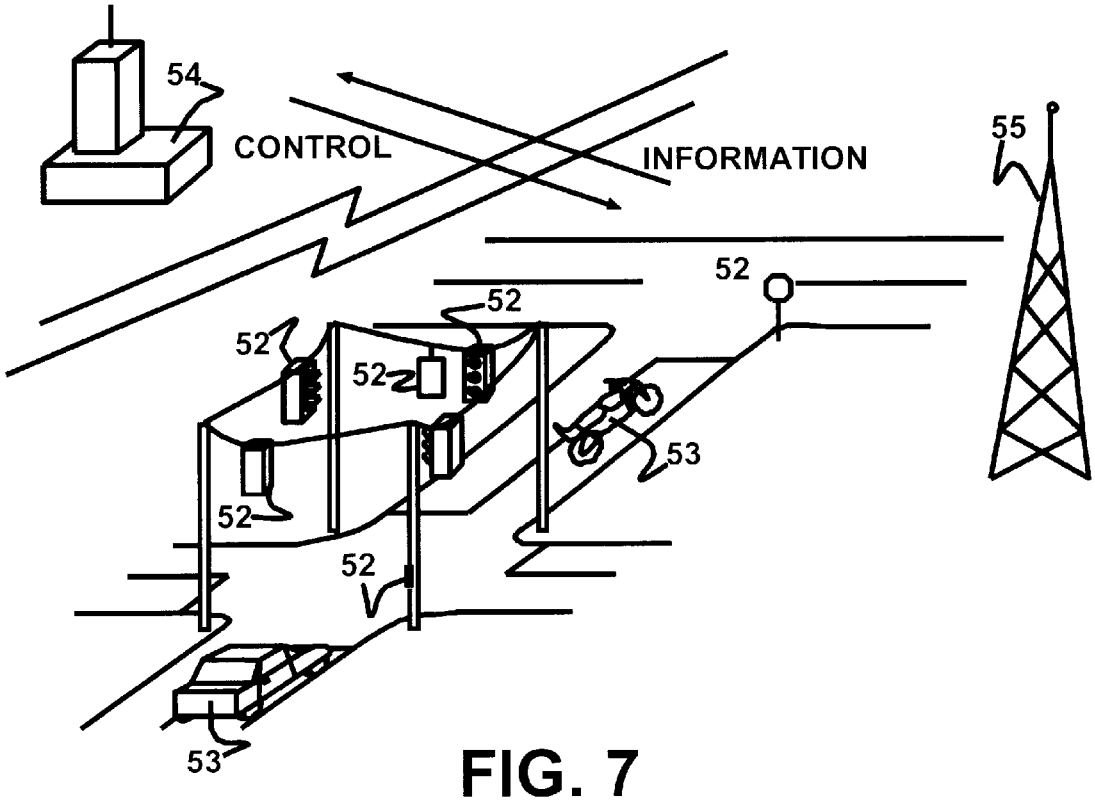
FIG. 7 is a representational view for explaining possible transmitter, relay and display system arrangements according to the invention.

FIG. 7 is a representational view for explaining possible transmitter, relay and display system arrangements according to the invention.

In a simplest arrangement, TCDTs attached to traffic control devices 52 can transmit to TCDIDSs in vehicles 53. This arrangement provides information to operators of the vehicles about nearby traffic control devices. One benefit of this arrangement is that operators of those vehicles could be made aware of upcoming traffic control devices, and possibly the states and/or status of those devices (e.g., red, green, speed limit, stop ahead, etc.), even if the devices are obscured by trees, fog, etc.

In another arrangement, the TCDTs can transmit to one or more TCDIDSs in a central office 54. This arrangement allows for centralized monitoring of the placement and possibly state and/or status of traffic control devices.

As discussed above, in order to facilitate coverage over a wider area, information transmitted by TCDTs can be retransmitted by relay devices. In one embodiment, these relay devices can be located in fixed locations such as relay tower 55. Other possible relay locations include buildings, signs and sign supports, power stations, etc. The relay devices can then retransmit the information to central office 54.

In another embodiment, the relay devices can be located in some or all of vehicles 53 themselves. Specialized roaming relay vehicles could be used. Alternatively, retransmitters can be added to any vehicles that have TCDIDSs. This embodiment is particularly economical because it merely requires the addition of retransmitters to the TCDIDSs in vehicles 53, possibly along with extra processing power to handle any format conversion used for the retransmission. Then, the TCDIDSs in vehicles 53 could display some or all of the information from nearby TCDTs and relay some or all of that information to a TCDIDS in central office 54. If retransmitters are added to enough vehicles 53, fixed relay devices would not even be needed to provide coverage over a wide area. Of course, they could be utilized if so desired.

By virtue of the foregoing arrangements, a municipality could implement a wide-area traffic control device monitoring system without having to lay cable, survey locations of all monitored traffic control devices, etc. Instead, the municipality could simply attach GPS-enabled TCDTs to the traffic control devices that need to be monitored, set up a relay system if necessary, and install a large TCDIDS in a central office. The GPS-enabled TCDTs would report their locations to the central office, which could then match the locations to a computerized map. The location, state and status of all monitored devices and their relationship to relevant roadways would then be available.

When combined with remote control devices for active traffic control devices (e.g., traffic signals), the central office implementation of the invention provides an extremely economical wide ranging traffic control device monitoring and control system. Preferably, the remote control is wireless, although hard-wired control can be used. If wireless, some form of security (e.g., encryption) should be used to prevent unauthorized control over the traffic control devices. Wireless remote control is representationally shown in FIG. 7 by the arrow marked "CONTROL."

Figure 8:
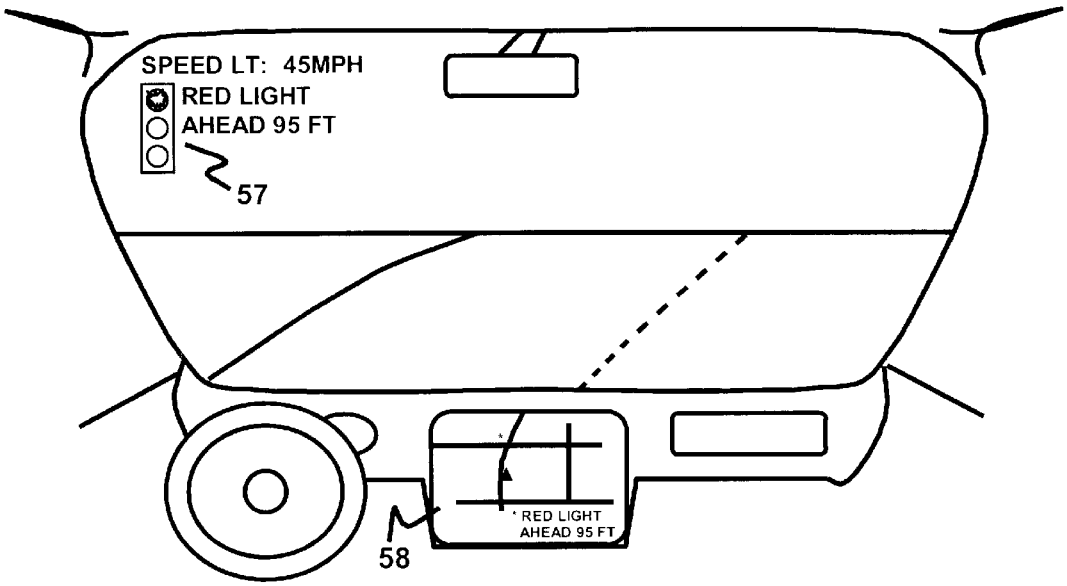
FIG. 8 shows possible in-vehicle displays for use with a traffic control device information display system according to the invention.

FIG. 8 shows possible in-vehicle displays for use with a traffic control device information display system according to the invention.

Heads-up display (HUD) 57 is projected or otherwise displayed on a vehicle's windshield. This display can show upcoming traffic control devices, possibly the state and/or status of the devices, and other information. For example, in FIG. 8, HUD 57 shows that the most recently passed speed limit sign identified the speed limit as 45 mph. Thus, the current "SPEED LT" is "45 MPH." In addition, a red light is detected 95 feet ahead. Thus, a graphic representation of a red light is displayed, along with text indicating that a "RED LIGHT" is "AHEAD 95 FT."

CRT display 58 shows similar information, along with a GPS-based mapping system showing the vehicle's location. In FIG. 8, an arrow on the CRT display 58 indicates the vehicle's location and direction. An annotation shows that a red light is at the intersection 95 feet ahead.

Other display formats and techniques are possible. For example, CRT display 58 could be replaced with an LCD display. Also, an audio "display" that warns of upcoming traffic control devices could be implemented. Other variations are possible.

Figure 9:
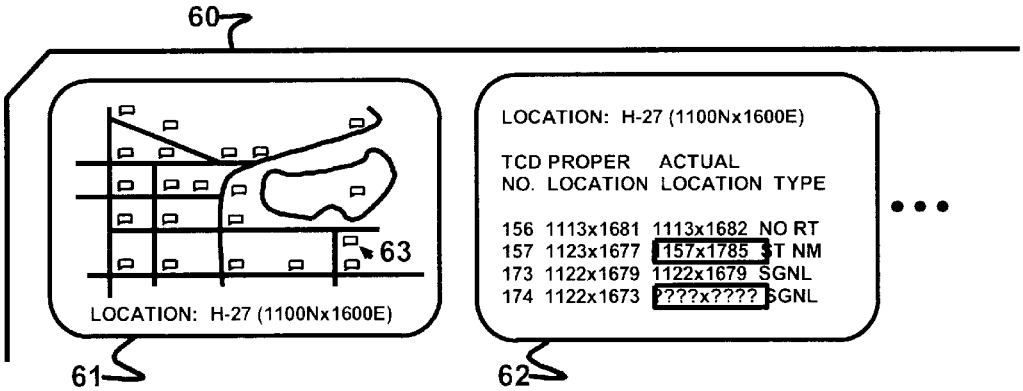
FIG. 9 shows possible displays for use in a central office for a traffic control device information display system according to the invention.

FIG. 9 shows possible displays for use in a central office for a traffic control device information display system according to the invention.

Console 60 in FIG. 9 includes two displays 61 and 62. Display 61 shows a graphical representation of a map. The bottom of display 61 indicates that the map represents a particular area, in this case grid coordinate H-27 located at 1100 North by 1600 East. The locations of TCDTs are shown by "balloons" on the map. Each balloon preferably provides information about a traffic control device, for example its identity, exact location, state and/or status. Cursor 63 is provided for selecting a balloon, possibly allowing for more detailed information to be presented.

Display 62 shows a text-based display of information from several TCDTs. This particular display shows identification numbers for several traffic control devices, the proper locations for those devices, the reported actual locations for the devices, and the types (i.e., identities) of the devices. For example, device 156 should be located at 1113N×1681E, is actually located at 1113N×1682E, and is a NO RT (i.e., no right turn) sign. Device 157 should be located at 1123N×1677E, is actually located at 1157N×1785E, as is a ST NM (i.e., street name) sign. This actual location is significantly different from where the sign should be located, so the actual location is highlighted, for example by use of a different color, flashing, etc.

Device 173 shown by display 62 should be located at 1122N×1679E, is actually located at 1122N×1679E, and is a SGNL (i.e., signal). Device 174 should be located at 1122N×1673E, has no reported actual location, and is a SGNL. Because an error of some type has occurred in the reported location, this information is also highlighted.

The information shown by displays 61 and 62 is coordinated in FIG. 9. In particular, the traffic control devices shown by display 62 correspond to devices that should be located at the cursor in display 61. The traffic control device shown to the north and slightly east of the cursor very well could be device number 157. In one embodiment of the invention, this device also would be highlighted in display 61 because its actual location would not match its proper location.

Of course, many other types and arrangements of displays could be implemented according to the invention. These displays could be coordinated with each other, operated independently, dedicated to specific locations, arranged in conjunction with other monitoring devices such as cameras, etc.

Alternative Embodiments

Although preferred embodiments of the invention are disclosed herein, many variations are possible which remain within the content, scope and spirit of the invention, and these variations would become clear to those skilled in the art after perusal of this application. Therefore, the scope of the invention encompasses the following claims and their legal equivalents and is not limited to the embodiments discussed and depicted above.

What is claims is:

1. A traffic control device information display system, comprising:

a receiver that receives information from a traffic control device transmitter for a traffic control device;

a processor that processes the information to determine identification information and location information for the traffic control device; and a display that displays the identification information and the location information to an operator;

wherein displayed information for the traffic control device indicates if an error is detected in the location information for the traffic control device, thereby indicating that the traffic control device may have been improperly moved or knocked down.

2. The traffic control device information display system according to claim 1, wherein the processor also determines state information for the traffic control device from the received information; and wherein the display also displays the state information to the operator.

3. The traffic control device information display system according to claim 1, wherein the processor also determines status information for the traffic control device from the received information; and wherein the display also displays the status information to the operator.

4. The traffic control device information display system according to claim 1, wherein the system is mounted inside a vehicle.

5. The traffic control device information display system according to claim 4, wherein the display is a heads-up display that projects the identification information and the location information onto the vehicle's windshield.

6. The traffic control device information display system according to claim 4, wherein the display is a CRT or an LCD display.

7. The traffic control device information display system according to claim 1, wherein the system is located in a central office.

8. The traffic control device information display system according to claim 7, further comprising a wireless remote control device for wireless remote control of the traffic control device from the central office.

9. The traffic control device information display system according to claim 1, wherein the displayed information indicates that the error is detected trough highlighting.

10. The traffic control device information display system according to claim 1, wherein the error is that the location information does not match a proper location for the traffic control device.

11. The traffic control device information display system according to claim 1, wherein the error is that the location information is missing.

12. The traffic control device information display system according to claim 1, wherein the receiver further receives additional information from plural additional traffic control device transmitters for plural additional traffic control devices;

wherein the processor further processes the additional information to determine additional identification information and additional location information for the plural additional traffic control devices;

wherein the display further displays at least some of the additional identification information and the additional location information to the operator; and wherein displayed information for one or more of the plural additional traffic control devices indicates if one or more errors are detected in the location information for those traffic control devices, thereby indicating that the traffic control devices may have been improperly moved or knocked down.

13. A method of displaying traffic control device information, comprising the steps of:

receiving information from a traffic control device transmitter for a traffic control device;

processing the information to determine identification information and location information for the traffic control device; and displaying the identification information and the location information to an operator;

wherein displayed information for the traffic control device indicates if an error is detected in the location information for the traffic control device, thereby indicating that the traffic control device may have been improperly moved or knocked down.

14. The method of displaying traffic control device information according to claim 13, further comprising the steps of:

determining state information for the traffic control device from the received information; and displaying the state information to the operator.

15. The method of displaying traffic control device information according to claim 13, further comprising the steps of:

determining status information for the traffic control device from the received information; and displaying the status information to the operator.

16. The method of displaying traffic control device information according to claim 13, wherein the identification information and the location information are displayed in a vehicle.

17. The method of displaying traffic control device information according to claim 16, wherein the display is a heads-up display that projects the identification information and the location information onto the vehicle's windshield.

18. The method of displaying traffic control device information according to claim 16, wherein the display is a CRT or an LCD display.

19. The method of displaying traffic control device information according to claim 13, wherein the identification information and the location information are displayed in a central office.

20. The method of displaying traffic control device information according to claim 19, further comprising the step of controlling the traffic control device from the central office using wireless remote control.

21. The method of displaying traffic control device information according to claim 13, wherein the displayed information indicates that the error is detected through highlighting.

22. The method of displaying traffic control device information according to claim 13, wherein the error is that the location information does not match a proper location for the traffic control device.

23. The method of displaying traffic control device information according to claim 13, wherein the error is that the location information is missing.

24. The method of displaying traffic control device information according to claim 13, wherein the receiving step further receives additional information from plural additional traffic control device transmitters for plural additional traffic control devices;

wherein processing step further processes the additional information to determine additional identification information and additional location information for the additional traffic control devices;

wherein the display further displays at least some of the additional identification information and the additional location information to the operator; and wherein displayed information for the plural additional traffic control devices indicates if one or more errors are detected in the location information for those traffic control devices, thereby indicating that the traffic control devices may have been improperly moved or knocked down.

* * * * *